United States Patent [19]

Bouwens

[11] 4,263,763

[45] Apr. 28, 1981

[54] ROOF INSULATION SUPPORT

[76] Inventor: Glenn J. Bouwens, Zeeland, Mich.

[21] Appl. No.: 20,527

[22] Filed: Mar. 14, 1979

[51] Int. Cl.[3] ..... E04B 1/74

[52] U.S. Cl. ..... 52/404; 52/486; 52/489

[58] Field of Search ..... 52/404, 483, 484, 486, 52/485, 716, 461, 489, 478

[56] References Cited

U.S. PATENT DOCUMENTS

| | | | |
|---|---|---|---|
| 3,295,284 | 1/1967 | Tschiesche | 52/483 |
| 3,512,323 | 5/1970 | Hupfer | 52/404 X |
| 3,514,915 | 6/1970 | Johnson | 52/393 |
| 3,553,915 | 1/1971 | Passovoy | 52/489 X |
| 3,618,281 | 11/1971 | Hill et al. | 52/404 |
| 3,662,509 | 5/1972 | Studzinski | 52/404 |
| 3,710,520 | 1/1973 | Federowicz | 52/484 X |
| 3,748,998 | 7/1973 | Lambert | 52/732 X |
| 3,791,089 | 2/1974 | Alderman | 52/484 |
| 3,961,454 | 6/1976 | Adams | 52/404 X |
| 3,979,537 | 9/1976 | Troyer | 52/404 X |
| 4,014,150 | 3/1977 | Wells et al. | 52/461 |
| 4,044,521 | 8/1977 | Fischer et al. | 52/404 |
| 4,117,641 | 10/1978 | Wells | 52/404 |

OTHER PUBLICATIONS

"Johns-Manville Money Clip Advertisement" Metal Building Dec. 1978.

*Primary Examiner*—J. Karl Bell

*Attorney, Agent, or Firm*—Price, Heneveld, Huizenga & Cooper

[57] ABSTRACT

A roof insulation support for a building roof of the type having a parallel array of longitudinally extending roof supporting purlins, each of the purlins including a longitudinally extending upturned lip. The roof support comprises a plurality of elongated longitudinally extending hangers, each hanger including a generally vertical web and a hook disposed on the top of the vertical web for supporting the hanger from the upturned lip of the purlins. First and second lower hanger flanges depends from both sides of the bottom of the vertical web and first and second upper hanger flanges are spaced upwardly on the vertical web from the first lower flange. A plurality of transversely extending beams of roughly I-shape cross section extend between the hangers. The ends of the beams are received between the upper and lower hanger flanges of adjacent hangers. The beams include lower and upper beam flanges defining a vertical height equal to the spacing between the lower and upper hanger flanges of the hangers to torsionally stabilize the transversely extending beams. A plurality of planar roof insulation supporting panels are supported by the lower flanges of both the longitudinally extending hangers and the transversely extending beams.

10 Claims, 2 Drawing Figures

ROOF INSULATION SUPPORT

BACKGROUND OF THE INVENTION

The invention relates generally to insulated roof structures and more particularly to a roof insulation support for a metal building.

In the construction of metal buildings, generally a plurality of transversely extending main roof support beams are provided for defining a peaked, sloped or flat roof. These transversely extending main roof support beams support a plurality of longitudinally extending purlins, the purlins being arranged in a generally parallel array. The purlins are of a channel or Z-shaped cross section and are usually provided with a longitudinally extending upturned lip disposed on the bottom of the purlin. The lower surface of the purlins is firmly secured to the transversely extending beams. Metal roof panels forming the exterior surface of the roof are then secured to the tops of the purlins.

These types of metal roof building structures have been insulated by a number of prior art arrangements. For example, it is not uncommon for a layer of rolled insulation and/or a layer of rigid closed cell foam insulation to be laid over the tops of the purlins before the metal roof panels are secured thereto. Problems with this roof insulating arrangement stem from the fact that the batts or rivets that are used to secure the metal roof panels to the purlins provide a thermal "short circuit" causing the purlins to be in good thermal conductivity with the exterior surface of the building. In addition to increasing heating and cooling costs, in the winter condensation of moisture on the purlins can become a problem. Other problems with this type of roof insulation include difficulty providing a layer of insulation of sufficient thickness to achieve the high insulation factors desirable with todays high energy costs and difficulty in upgrading the insulation factor of existing insulation of this type.

It has also been known to secure roof liner panels to the bottoms of the purlins with bolts, rivets, or the like and to fill the space between the roof liner panels and the metal roof panels with fiberglass insulation or the like. However, the process of attaching the roof liner panels to the lower flanges of the purlins by means of rivets or screws is a very time consuming one, resulting in high labor costs. Thus, a variety of prior art roof insulating systems evolved, employing longitudinally extending roof liner panel hangers which are provided with resilient clips for gripping the bottoms of the purlins. These hangers are generally provided with an inverted T-shaped cross section defining a bottom flange upon which the roof liner panels rest. The roof liner panels extended between adjacent hangers and, in some cases where the distance between hangers is great, transversely extending beams, also supported by the hanger flanges, are disposed between adjacent roof liner panels. These transversely extending beams are also provided with T-shaped cross sections to define lower flanges for supporting the transversely extending edges of the roof liner panels.

While this latter type of roof insulation support system is easier to install then systems involving the attachment of roof liner panels with screws, rivets or the like, and in fact, this system can be retrofitted on an existing building structure, the resilient clips of prior art hangers often do not fit purlins of varying thickness or accommodate sections of the roof structure where the purlins were overlapped. In cases where the distance between purlins is great and additional support for the roof liner panels is provided by transverse beams, installation is made awkward by the poor torsional stability of the beams. The torsional stability of the transversely extending beams is important since if a transversely extending beam rotates during installation of the panels, a tight pack of the panels will not be achieved. Also, the poor torsional stability of the beams makes reentry into the insulated space for maintenance on pipes and other fixtures in the insulated space difficult since removal of one or more of the panels may loosen the packing of the panels, allowing one or more of the beams to rotate as the panels are manipulated. The poor torsional stability of the transversely extending beams hamper installation of the beams and made reentry into the insulated space somewhat more tedious.

SUMMARY OF THE INVENTION

These and other problems in the prior art are solved by provision of a roof insulation support comprising a plurality of elongated longitudinally extending hangers. Each of the longitudinally extending hangers comprise a generally vertical web, fastening means disposed on the top of the vertical web for supporting the hangers from the upturned lip on each purlin, and first and second lower hanger flanges and first and second upper hanger depending from the vertical web. The lower and upper hanger flanges depend from opposing sides of the vertical web, the upper hanger flange being upwardly spaced from the lower hanger flange and roughly parallel thereto. A plurality of transversely extending beams of roughly I-shaped cross section extend between the hangers. The transversely extending beams define a lower beam flange and an upper beam flange. The ends of the transversely extending beams are received between the upper and lower hanger flanges of adjacent hangers and the beams are provided with a vertical height equal to the spacing between the upper and lower hanger flanges. Thus, interference between the first lower and upper flanges of the longitudinally extending hangers and the second lower and upper flanges of the transversely extending beams torsionally stabilize the beams between the hangers. The planar roof insulation support panels are supported by the first and second lower flanges on adjacent pairs of longitudinally extending hangers and transversely extending beams, respectively.

In more narrow aspects of the invention, the fastening means comprises a longitudinally extending hook formed from a generally vertical portion of the web extending above the first upper flange. A wall extends horizontally from the top edge of this generally vertical portion of the web and a longitudinally extending downwardly turned lip extends from the end of this wall. The downturned lip of the hook defines an oblique angle with respect to the generally horizontally extending wall such that the downturned lip roughly mates with the upturned lip of each purlin. The vertical portion of the web extending above the first upper flange extends a distance greater than twice the expected thickness of the purlins to accommodate overlapped purlins of varying thicknesses.

DESCRIPTION OF THE PREFERRED EMBODIMENTS

Figure 1:
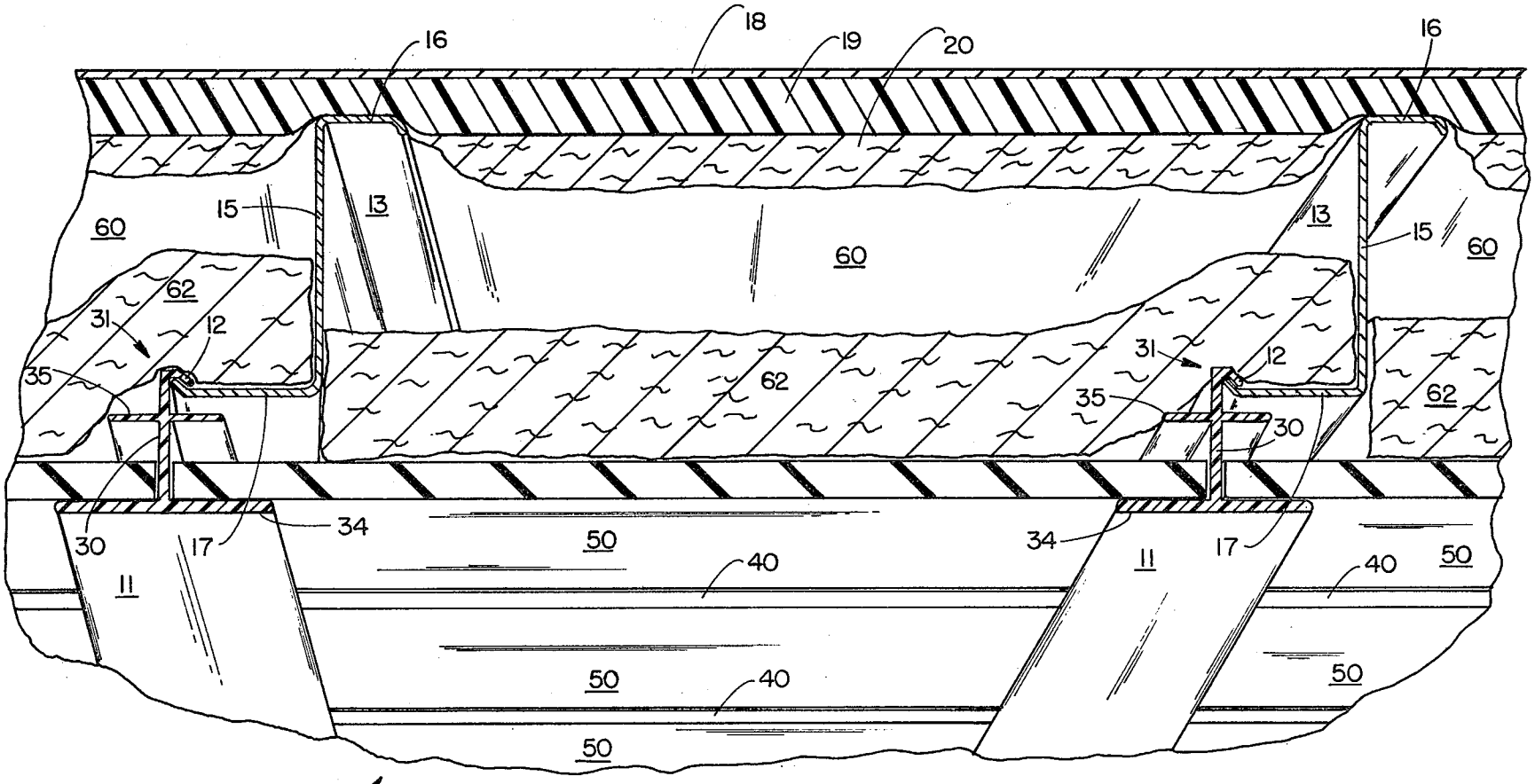
FIG. 1 is a sectional perspective view of the roof insulation support of the present invention installed in a metal building roof.

Referring to FIG. 1, the insulation support system of the present invention is generally indicated by the numeral 10. The insulation support includes a plurality of elongate longitudinally extending hangers 11 which depend from the upturned lips 12 of the purlins 13. In this case, the longitudinally extending purlins 13 are Z-shaped in cross section comprising a vertical wall 15 and top and bottom generally horizontally extending sections 16 and 17, respectively. The bottom sections 17 of the purlins 13 are supported by transversely extending beams not illustrated in FIG. 1. The top portions 16 of the purlins 13 support metal roof panels 18 comprising the exterior surface of the building roof. A layer of closed cell foam insulation at 19 and a layer of rolled insulation at 20 are sandwiched between the purlins 13 and the panels 18. Typically, bolts, rivets or the like secure the metal panels 18, the closed cell foam 19 and the rolled insulation 20 to the top portion 16 of each purlin 13.

The hangers 11 each comprise a generally vertical web 30, fastening means, generally indicated by the numeral 31, disposed atop vertical web 30 and first lower and first upper flanges 34 and 35, respectively, depending from the vertical web. The first upper and lower flanges 34 and 35 extend from both sides of the vertical web 30. The first lower flange 34 extends from the bottom of the vertical web 30 and the first upper flange 35 is spaced upwardly from the first lower flange 34.

Figure 3:
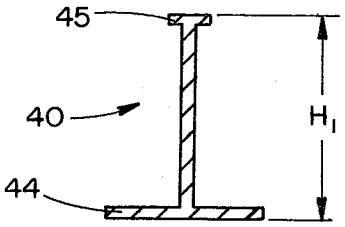
FIG. 3 is a cross section of the transversely extending beams of the roof support of the present invention.
Figure 4:
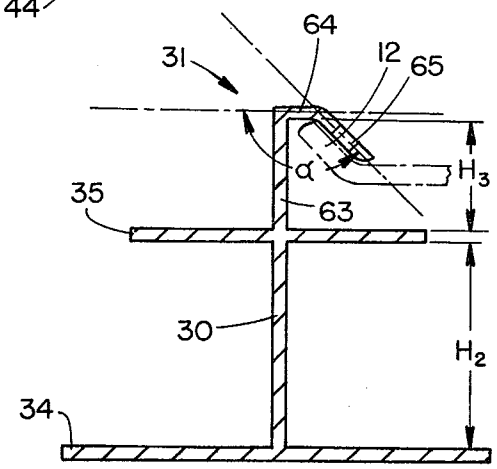
FIG. 4 is a cross-sectional view of the longitudinally extending hangers of the roof insulation support of the present invention.
Figure 2:
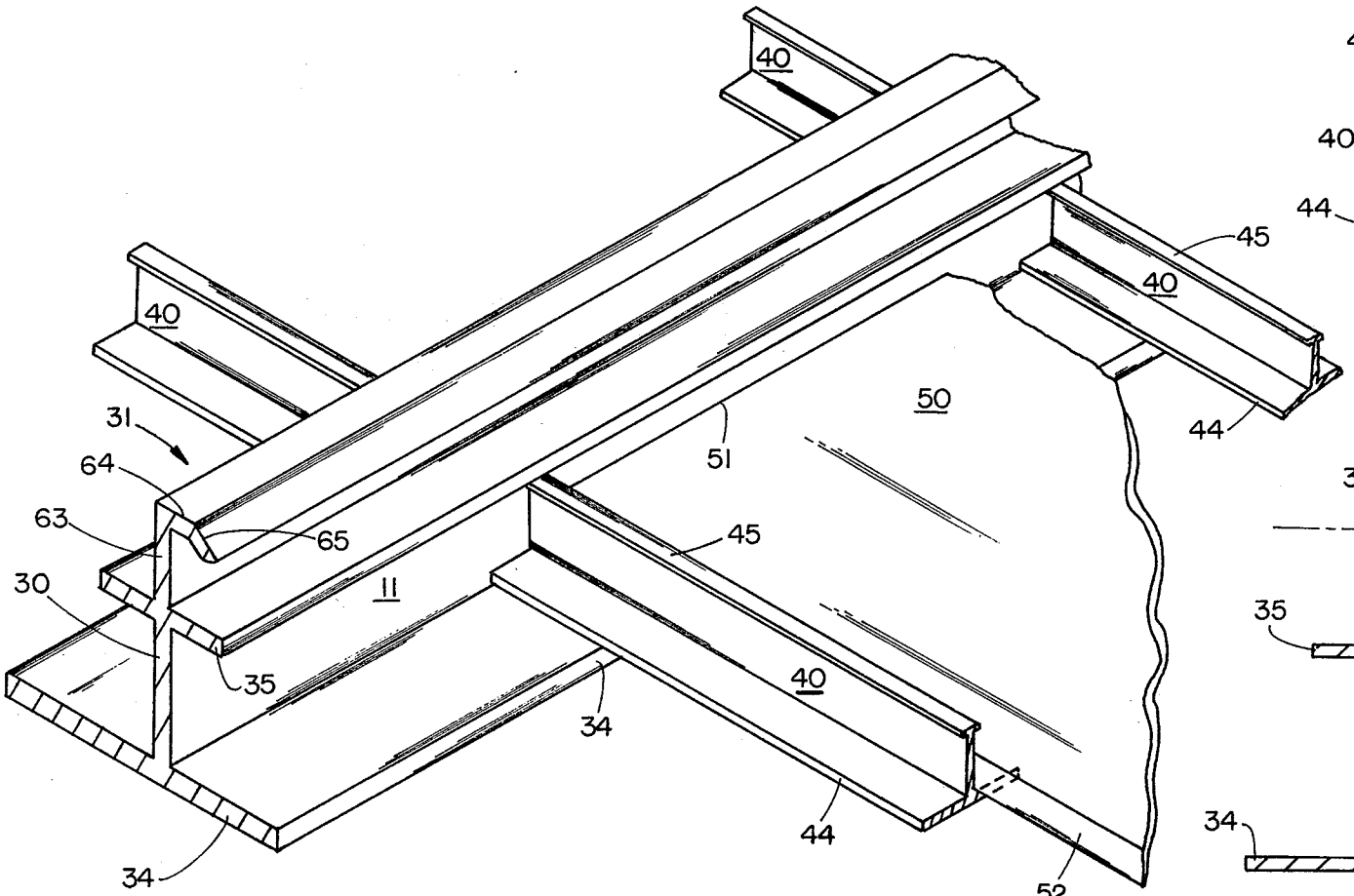
FIG. 2 is a perspective view of the roof insulation support of the present invention.

Referring now also to FIGS. 2, 3 and 4, it is illustrated that a plurality of transversely extending beams 40 are provided of generally I-shaped cross section. The transversely extending beams 40 extend between adjacent hangers 11, the ends of the beams 40 being received between the first upper and the first lower flanges 34 and 35 of adjacent hangers. The transversely extending beams 40 define lower and upper beam flanges 44 and 45, respectively. The transversely extending beams 40 are provided with an overall height $H_1$, best illustrated in FIG. 3, which is equal to the vertical spacing $H_2$ between the lower and upper hanger flanges 34 and 35 of the longitudinally extending hangers 11, best illustrated in FIG. 4. Since the ends of the transversely extending beams 40 are received between the first upper and lower flanges of the hangers 11, the transversely extending beams 40 are torsionally stabilized between adjacent pairs of longitudinally extending hangers 11, by interaction between the lower and upper hanger flanges 34 and 35 of the hangers 11 and the lower and upper beam flanges 44 and 45 of the beams 40.

Referring now specifically to FIGS. 1 and 2, it is illustrated that the lower flanges 34 and 44 of the longitudinally extending hangers 11 and the transversely extending beams 40, respectively, support a plurality of generally planar roof insulation support panels 50. These roof insulation support panels or roof liner panels 50 are slid into place between adjacent pairs of longitudinally extending hangers 11. The opposed longitudinally extending edges 51 of the panels 50 are completely supported by the hangers 11 while the opposed transversely extending edges 52 of each of the panels 50 is completely supported by the beams 40. The assembled insulation support defines an air space 60 between the outer metal panel 18 of the roof structure and the insulation support panels 50. This air space 60 is filled with any suitable type of insulation such as the fiberglass batt insulation, illustrated at 62 in FIG 1. The air space 60 may be completely filled with fiberglass batting or other similar material or, as illustrated in FIG. 1, a single fiberglass batt may be provided to define an insulating air space between the outer metal panel 11 and the fiberglass batt 62. The size of insulating space 60 may be varied by providing longitudinally extending hangers 11 with a vertical web 30 of varying length.

Referring now specifically to FIG. 4, the fastening means 31 disposed atop the vertical web 30 of each longitudinally extending hanger 11 is illustrated in further detail. The fastening means 31 comprises a generally vertical portion 63 of the web 30 extending above the upper hanger flanges 35. A generally horizontal wall 64 extends from the top edge of the vertical wall 63. A longitudinally extending downwardly turned lip 65 extends from the edge of the generally horizontally extending wall 64. A downturned longitudinally extending lip 65 forms an oblique angle $\alpha$ with the generally horizontally extending wall 64 such that the downturned lip 65 roughly mates with the upturned longitudinally extending lip 12, illustrated in phantom in FIG. 4, of each of the purlins 13. The horizontally extending wall 64 is spaced upwardly from the upper hanger flange 35 a distance $H_3$ which preferably is equal to or greater than twice the thickness of the purlins 13. In this manner, the hook 31 may accommodate overlapped purlins and a wide range of purlin sizes.

Preferably, the longitudinally extending hangers 11 are made of an extruded plastic material such as polyvinylchloride. The transversely extending beams 40 may also be manufactured from an extruded plastic material or, in the case where the loading on the panels 50 is quite high, and/or where transverse spacing between longitudinally extending hangers 11 is quite large, the beams 40 may be formed of steel. Preferably, the roof insulation support panels 50 are made of an acoustical insulation material so that in addition to improving the aesthetic appearance of the roof, reflected noise within the metal building is dramatically reduced. Also, preferably, the insulation support panels 50 are provided with a layer of impervious plastic or the like to act as a vapor barrier. This prevents water vapor from entering the air space 60 to condense upon the purlins 13 which are in good thermal contact with the outer skin 18 of the metal building structure. The overall vertical height $H_1$ of each of the transversely extending beams 40 and the spacing $H_2$ between the lower and upper hanger flanges of each longitudinally extending hanger 11 is larger than the average expected thickness of the roof insulation support panels 50 so that the hangers 11 and transversely extending beams 40 will accept roof insulation support panels 50 having a wide range of thicknesses.

The roof insulation support of the present invention may be installed in a preexisting metal structure to reduce heat loss through the roof and to prevent condensation on the purlins which are in good thermal contact with the outer metal skin of the roof. Such an installation is depicted in FIG. 1. For example, FIG. 1 illustrates a typical preexisting metal roof structure having a layer of closed cell foam 19 and rolled insulation 20 sandwiched between the tops of purlins 13 and the outer metal panels 18 of the roof structure. When such a retrofitting installation operation is desired the longitudinally extending hangers 11 are simply hung from the longitudinally extending purlins 13. Transversely extending beams 40 and the insulation support panels 50 may then be installed. Preferably, at least one linear transversely extending array of panels 50 and transversely extending beams 40 should be installed to torsionally stabilize the longitudinally extending hangers 11. Then, a longitudinally extending array of insulation support panels 50 with transversely extending beams 40 disposed therebetween may be formed between adjacent pairs of longitudinally extending hangers 11 by alternately sliding beams 40 and panels 50 between flanges of the hangers 11 and packing the same in a longitudinally extending array. The air space 60 thus defined between the outer metal panel 18 of the roof structure and the insulation support panel 50 is then filled with a suitable insulating material such as sections of fiberglass batting illustrated at 62 in FIG. 1.

In the case where the insulation support of the present invention is being added to a metal building structure during its initial construction, it is possible to install the insulation support after the purlins have been mounted to the tops of the transversely extending beams of the roof structure and before the outer metal panel 18 have been secured to the top of purlins 13. In this case, fiberglass batting 62 or other suitable form of insulation to be disposed in the air space 60 will be rolled or poured into place before the outer metal panels 18 are secured to the top of the purlins 13.

The above description should be considered as exemplary and that of the preferred embodiment only. The true spirit and scope of the present invention should be determined by reference to the appended claims. It is desired to include within the appended claims all modifications that come within the proper scope of the invention.

The embodiments of the invention in which an exclusive property or privilege is claimed are defined as follows.

1. A roof insulation support, for a building roof of the type having a parallel array of longitudinally extending purlins each of said purlins including a longitudinally extending upturned lip disposed on the bottom of the purlins, said roof insulation support comprising in combination:

a plurality of elongated longitudinally extending hangers each of said hangers comprising:

(i) a generally vertical web;

(ii) fastening means disposed on the top of said vertical web for supporting said hangers from the upturned lip on each purlin;

(iii) first and second lower hanger flanges depending from opposing sides and adjacent the bottom of said vertical web; and (iv) first and second upper hanger flanges depending from opposing sides of said vertical web, said upper hanger flanges being upwardly spaced from said lower hanger flanges and roughly parallel thereto;

a plurality of transversely extending beams extending between said hangers, said beams having a roughly I-shaped cross section defining a lower beam flange and an upper beam flange, said beams having a vertical height equal to the spacing between said upper and lower hanger flanges and the ends of said beams being received between said upper and lower hanger flanges of adjacent hangers to torsionally stabilize said beams; and a plurality of planar roof insulation support panels supported by said lower hanger flanges and said lower beam flanges.

2. The roof insulation support of claim 1 wherein said fastening means comprises a longitudinally extending hook.

3. The roof insulation support of claim 2 wherein said longitudinally extending hook comprises:

a generally vertical portion of said web extending above said upper hanger flanges;

a wall extending generally horizontally from one side of the top edge of said web; and a downturned longitudinally extending lip roughly mating with the longitudinally upturned lip on each purlin.

4. The roof insulation support of claim 3 wherein said wall is spaced upwardly from said upper hanger flanges a distance equal to or larger than twice the thickness of the purlins.

5. The roof insulation support of claim 1 wherein at least one of said hangers and said beams is a plastic extrusion.

6. The roof insulation support of claim 5 wherein said beams are formed of metal.

7. The roof insulation support of claim 6 wherein said beams are formed of steel.

8. The roof insulation support of claim 1 wherein said panels comprise acoustical insulation panels.

9. The roof insulation support of claim 1 wherein said panels carry a plastic coating to provide a vapor barrier.

10. The roof insulation support of claim 1 wherein the vertical spacing between said upper and lower hanger flanges and said upper and lower beam flanges is greater than the thickness of said panels.

* * * * *

UNITED STATES PATENT AND TRADEMARK OFFICE

CERTIFICATE OF CORRECTION

PATENT NO. : 4,263,763

DATED : April 28, 1981

INVENTOR(S) : Glenn J. Bouwens

It is certified that error appears in the above—identified patent and that said Letters Patent is hereby corrected as shown below:

Column 2, line 40:

Delete "first" and after "upper" insert --hanger--;

Column 2, line 41:

Delete "second" and after "upper" insert --beam--

Column 2, lines 44 and 45:

Delete "first" and delete "second";

Column 2, line 51:

Delete "first" and after "upper" insert --hanger--;

Column 3, line 36:

After "first" insert --and second--;

After "lower" insert --hanger flanges at 34--

Column 3, line 36:

Before "upper" insert --and second--;

After "upper" insert --hanger--;

Delete "34 and" and insert --at--;

UNITED STATES PATENT AND TRADEMARK OFFICE

CERTIFICATE OF CORRECTION

PATENT NO. : 4,263,763
DATED : April 28, 1981
INVENTOR(S) : Glenn J. Bouwens

It is certified that error appears in the above—identified patent and that said Letters Patent is hereby corrected as shown below:

Column 3, lines 37, 38:

Delete "first" and after "lower" insert --hanger--;

Column 3, line 39:

Delete "first";

Column 3, line 39:

Delete "flange" and insert --hanger flanges--;

Delete "extends" and insert --extend--;

Column 3, lines 40, 41:

Delete "first"; Delete "flange" and insert --hanger flanges--;

Delete "is" and insert --are--;

Column 3, line 48:

Delete both occurrences of "first"; after lower insert --hanger--;

UNITED STATES PATENT AND TRADEMARK OFFICE

CERTIFICATE OF CORRECTION

PATENT NO. : 4,263,763

DATED : April 28, 1981

INVENTOR(S) : Glenn J. Bouwens

It is certified that error appears in the above—identified patent and that said Letters Patent is hereby corrected as shown below:

Column 3, line 57:

Delete "first"; after "lower" insert --hanger--.

Signed and Sealed this

Tenth Day of November 1981

[SEAL]

Attest:

GERALD J. MOSSINGHOFF

Attesting Officer

Commissioner of Patents and Trademarks